US005802196A

United States Patent [19]

Nakamura

[11] Patent Number: 5,802,196

[45] Date of Patent: Sep. 1, 1998

[54] SPEAKER FOR RADIATING SOUND WAVES IN ALL DIRECTIONS RELATIVE TO A SPEAKER SUPPORTING SURFACE

[75] Inventor: Takeshi Nakamura, Uji, Japan

[73] Assignee: Murata Manufacturing Co., Ltd., Kyoto, Japan

[21] Appl. No.: 760,639

[22] Filed: Dec. 4, 1996

[30] Foreign Application Priority Data

Dec. 14, 1995 [JP] Japan ..... 7-347884

[51] Int. Cl.[6] ..... H04R 25/00

[52] U.S. Cl. ..... 381/202; 381/190; 381/191; 381/188; 381/156; 381/160; 310/322; 310/324; 181/159; 181/155

[58] Field of Search ..... 381/190, 191, 381/202, 156, 204, 160, 188, 205; 310/322, 324; 181/157, 159, 171, 177, 179, 198, 199, 155

[56] References Cited

U.S. PATENT DOCUMENTS

| | | | |
|---|---|---|---|
| 2,107,757 | 2/1938 | Knisley | 381/156 |
| 2,907,837 | 10/1959 | Brami | 381/156 |
| 3,310,131 | 3/1967 | Ward | 181/157 |
| 4,143,738 | 3/1979 | Nakazono et al. | 381/156 |
| 4,369,857 | 1/1983 | Frazer et al. | 181/159 |
| 4,472,605 | 9/1984 | Klein | 79/181 |
| 4,584,439 | 4/1986 | Paddock et al. | 181/173 |
| 4,903,308 | 2/1990 | Paddock et al. | 181/173 |
| 5,115,882 | 5/1992 | Woody | 381/160 |
| 5,185,549 | 2/1993 | Sullivan | 310/334 |
| 5,351,220 | 9/1994 | Noselli | 367/175 |

FOREIGN PATENT DOCUMENTS

| | | | |
|---|---|---|---|
| 0166396 | 12/1980 | Japan | 381/156 |
| 4-329799 | 11/1990 | Japan | 381/199 |

*Primary Examiner*—Curtis Kuntz
*Assistant Examiner*—Rexford N. Barnie
*Attorney, Agent, or Firm*—Graham & James LLP

[57] ABSTRACT

A speaker is adapted to transmit sound waves in an omni-directional manner relative to an installation surface upon which the speaker is mounted. The speaker includes an oscillator having a hemispherical oscillating body comprising a piezoelectric body polarized in a thickness direction thereof, a pair of electrodes provided on an inner surface and an outer surface of the oscillating body, input terminals connected to the electrodes via lead wires, an end portion of the oscillator being connected to spacers in a groove to cover a projecting portion of a horn, a cavity communicating with a hole of the horn and being defined between the oscillator and the horn and support members fixed to a flange portion of the horn whereby a sound transmission path communicating with the hole of the horn is defined between the horn and the installation surface upon which the speaker is mounted such that the sound transmission path extends in all directions relative to the installation surface.

20 Claims, 6 Drawing Sheets

SPEAKER FOR RADIATING SOUND WAVES IN ALL DIRECTIONS RELATIVE TO A SPEAKER SUPPORTING SURFACE

BACKGROUND OF THE INVENTION

1. Field of the Invention

The present invention relates to a speaker, more particularly to a speaker adapted to transform electric signals into sound waves and radiate the sound waves in all directions relative to a surface upon which the speaker is supported.

2. Description of Related Art

Conventional speakers include a cone type speaker using a cone for transmitting sound waves, a horn type speaker using a horn for transmitting sound waves and a plane type speaker using a piezoelectric element formed to have a flat plate shape for transmitting sound waves.

However, all of the conventional speakers are arranged such that a sound wave transmitting member, such as the cone, the horn or the flat plate, are arranged substantially parallel to an installation surface upon which the speaker is supported. For example, the sound transmitting hole in the cone or horn of most conventional speakers extends parallel to the installation surface. As a result, the conventional speakers have directivities or sound wave transmissions only in directions parallel to an installation surface or a floor surface upon which the speaker is supported. Therefore, sound waves cannot be radiated in all directions (360°) relative to an installation surface or a floor surface.

SUMMARY OF THE INVENTION

To overcome the disadvantages of the conventional speakers, the preferred embodiments of the present invention provide a speaker which achieves omni-directional transmission of sound waves relative to an installation surface upon which the speaker is supported.

According to a first preferred embodiment of the present invention, there is provided a speaker comprising an oscillator having a hemispherical shape, a driving device for oscillating the oscillator and a horn extending from a curved inner surface of the oscillator toward an outer surface thereof and having a hole gradually expanding from the curved inner surface of the oscillator toward the outer surface thereof, wherein a cavity communicating with the hole of the horn is defined between the oscillator and the horn and a sound transmission path communicating with the hole of the horn in substantially all directions relative to an installation surface upon which the speaker is supported is defined between the horn and the installation surface.

According to another preferred embodiment of the present invention, there is provided a speaker in which a reflecting member for reflecting sound waves radiated from a curved outer surface of the oscillator in all directions relative to the installation surface upon which the speaker is mounted, is arranged above the curved outer surface of the oscillator.

According to another preferred embodiment of the present invention, there is provided a speaker substantially in accordance with the first preferred embodiment of the speaker, further comprising a second oscillator having a hemispherical shape having a curved outer surface arranged oppositely to the curved outer surface of the first oscillator and spaced therefrom, a second driving device for driving the second oscillator, a second horn arranged to extend from a curved inner surface of the second oscillator toward the outer surface thereof and having a hole gradually expanding from the curved inner surface of the second oscillator toward the outer surface thereof and a baffle arranged in the vicinity of an opening portion of the hole of the second horn and having a surface opposed to the opening portion and substantially parallel to the installation surface, wherein a second cavity communicating with the hole of the second horn is defined between the second oscillator and the second horn, a second sound transmission path communicating with the hole of the second horn and being arranged to radiate sound waves in substantially all directions relative to the installation surface is defined between the second horn and the baffle and a third sound transmitting path is defined between the first oscillator and the second oscillator and is arranged to radiate sound waves in substantially all directions relative to the installation surface.

According to the speaker in accordance with the preferred embodiments of the present invention, when an electric signal is inputted, the oscillator is oscillated by the driving device, sound waves are radiated from the curved outer surface of the oscillator and further, the sound waves are radiated from the curved inner surface of the oscillating body via the cavity, the hole of the horn and the sound transmission path.

Thus, the sound waves radiated from the curved outer surface of the oscillator are radiated in substantially all directions away from the installation surface and are omni-directional relative to the installation surface since the oscillating body has a hemispherical shape. Further, the sound waves radiated from the curved inner surface of the oscillator via the cavity, the hole of the horn and the sound transmission path, are radiated in all directions toward the installation surface because the oscillating body and the horn are arranged in a unique manner such that the hole of the horn extends in a direction substantially perpendicular to the installation surface and so as to define the cavity and sound transmission path resulting in sound waves being radiated in substantially all directions relative to the installation surface upon which the speaker is supported. Therefore, the sound waves generated by this speaker are transmitted in an omni-directional manner relative to an installation surface, in directions both toward and away from the installation surface.

In addition, the second aspect of the speaker in accordance with the preferred embodiments of the present invention has a reflecting member arranged above the curved outer surface of the oscillator such that the sound waves radiated from the curved outer surface of the oscillator are reflected in all directions relative to the installation surface by the reflecting member and therefore, the sound pressure of the sound waves is enhanced.

Further, according to a third preferred embodiment of the speaker in accordance with the present invention, the speaker further includes a second oscillator, a second driving device, a second horn and a baffle and cavity, wherein first, second and third sound transmission paths are defined, the sound pressure of the second waves is further enhanced relative to an installation surface since the sound waves are radiated from the two oscillating bodies in all directions relative to the installation surface on which the speaker is supported.

The above-described objects, other objects, characteristics and advantages of the present invention will further be clarified from a detailed description of preferred embodiments of the invention which will be carried out as follows in reference to the drawings.

DETAILED DESCRIPTION OF PREFERRED EMBODIMENTS

Figure 1:
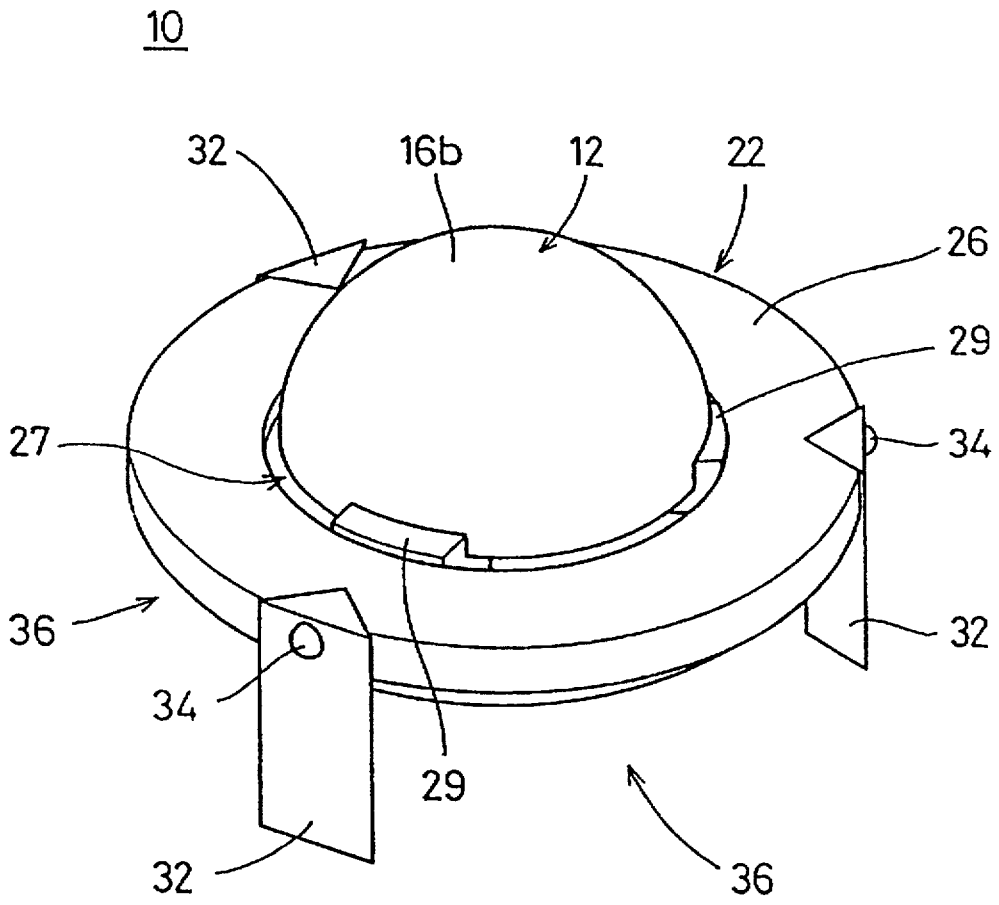
FIG. 1 is a perspective view showing an example of preferred embodiments of the present invention.
Figure 2:
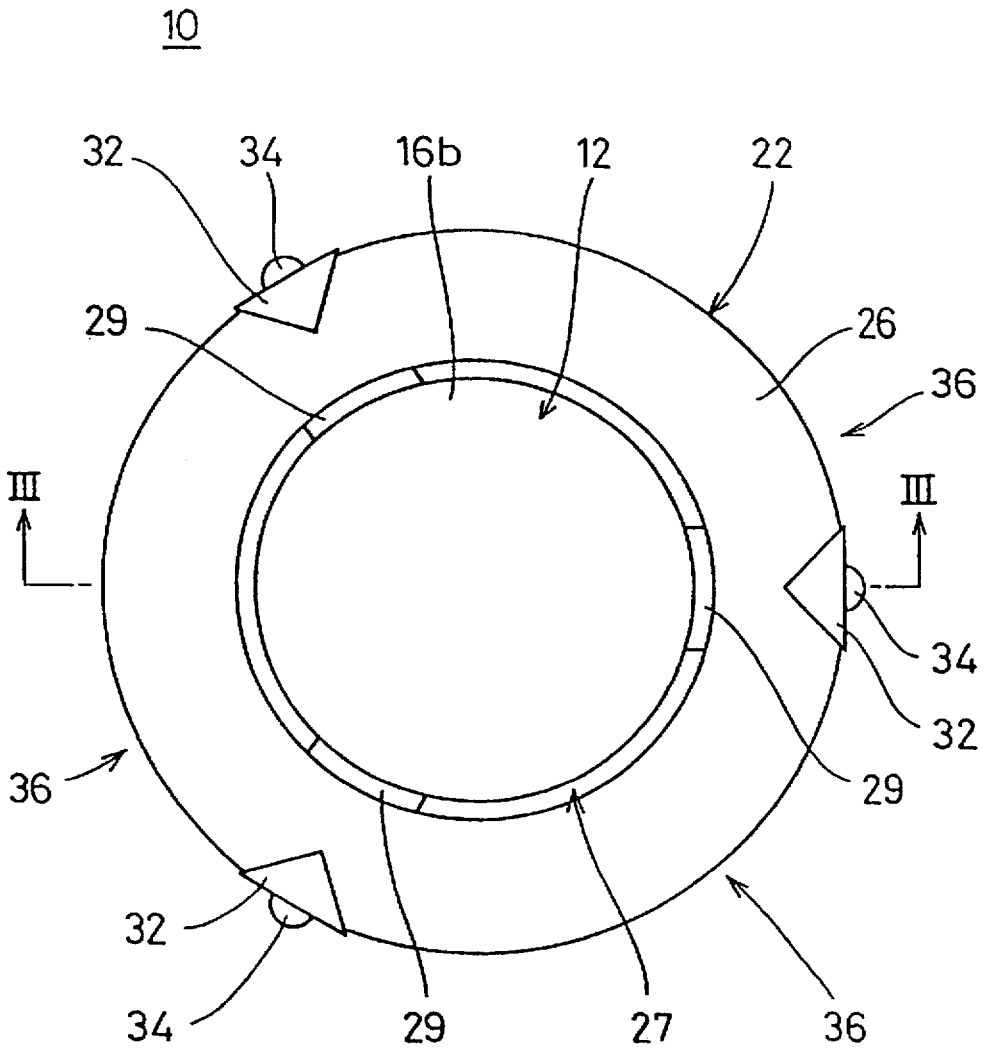
FIG. 2 is a plane view of a speaker illustrated by FIG. 1.
Figure 3:
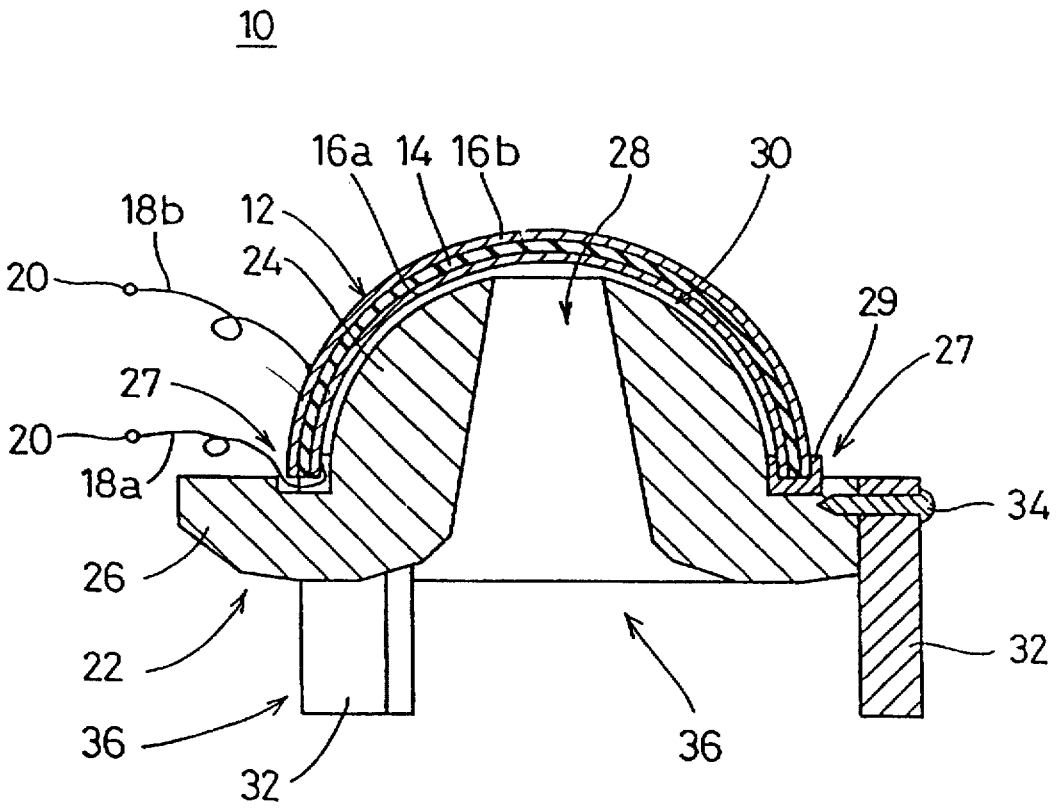
FIG. 3 is a sectional view taken along a line III—III in FIG. 2.

FIG. 1 is a perspective view showing an example of preferred embodiments of the present invention, FIG. 2 is a plane view of FIG. 1 and FIG. 3 is a sectional view taken along a line III—III of FIG. 2. A speaker 10 illustrated by FIG. 1 through FIG. 3 includes a hemispherical oscillator 12.

The oscillator 12 includes a hemispherical oscillating body 14 preferably formed by a piezoelectric body made of, for example, ceramics and/or other suitable materials. Electrodes 16*a* and 16*b* function as a driving device for oscillating the oscillating body 14. The electrodes 16*a* and 16*b* are disposed on a curved inner surface and a curved outer surface, respectively, of the oscillating body 14. Input terminals 20 are connected to the electrodes 16*a* and 16*b* via lead wires 18*a* and 18*b*. Further, the oscillating body 14 is preferably polarized in the thickness direction, for example, from the inner surface toward the outer surface of the oscillating body 14.

The oscillator 12 is fixed to a horn 22 made of, for example, aluminum or other suitable material. The horn 22 preferably has a hemispherical projecting portion 24 having a shape that substantially corresponds to a shape of the oscillator 12 and a flange portion 26 disposed at the outer circumference of the projecting portion 24. Also, a groove 27 is located between the projecting portion 24 and the flange portion 26. Further, a hole for transmitting sound waves is formed at substantially the center of the projecting portion 24 to expand gradually from an upper portion of the projecting portion 24 to a lower portion of the projecting portion 24 as seen in FIG. 3. Additionally, the edge portion of the oscillator 12 is fixed to a plurality of spacers 29 in the groove 27 to cover the projecting portion 24 of the horn 22. In this case, a cavity 30 for allowing for vibration of the oscillator 12 is formed between the oscillator 12 and the horn 22 and the cavity 30 is arranged to communicate with the hole 28. Incidentally, the lead wire 18*a* is preferably drawn from the inside of the oscillator 12 to the outside thereof via the groove 27.

End portions of a plurality of support members 32 preferably arranged in a triangular column form and made of aluminum are fixed to the flange portion 26 of the horn 22 respectively by connecting members such as screws 34. The support members 32 position and maintain the hole 28 of the horn 22 spaced from and above an installation surface or a floor surface upon which the speaker is supported. The support members 32 define a sound transmission path 36 for transmitting sound waves in communication with the hole 28 of the horn 22. As a result, the path 36 extends in all directions and radiates sound waves in all directions relative to an installation surface or a floor surface upon which the speaker is supported.

Further, in order to prevent sound waves radiated from the curved outer surface of the oscillator 12 and sound waves radiated from the curved inner surface of the oscillator 12 via the cavity 30, the hole 28 and the path 36 from canceling each other, the cavity 30, the hole 28 and the path 36 are arranged such that these sound waves are provided with substantially the same phase relative to the installation surface or a floor surface.

When an electric signal is inputted to the input terminals 20, the oscillator 12 is oscillated, sound waves are radiated from the curved outer surface of the oscillator 12 and sound waves are radiated from the curved inner surface of the oscillator 12 via the cavity 30, the hole 28 and the path 36.

Sound waves radiated from the curved outer surface of the oscillator 12 are radiated in all directions and are omni-directional relative to an installation surface or a floor surface upon which the speaker is supported because the oscillator 12 or the oscillating body 14 has a hemispherical shape and is arranged in a unique manner relative to the installation surface. Also, sound waves radiated from the curved inner surface of the oscillator 12 via the cavity 30, the hole 28 and the path 36 are radiated in all directions and are omni-directional relative to an installation surface or a floor surface because the path 36 is arranged substantially omni-directionally relative to the installation surface. Accordingly, the speaker 10 radiates sound waves in all directions relative to the installation surface or floor surface upon which the speaker is supported.

A difference between phases of the sound waves radiated from the curved outer surface of the oscillator 12 and the sound waves radiated from the curved inner surface of the oscillator 12 is about 180°. However, these sound waves are provided with substantially the same phase relative to the supporting surface or the floor surface via the cavity 30, the hole 28 and the sound transmission path 36 which also function as a phase shifting device. Accordingly, with the structure of the speaker 10, sound waves travelling in directions substantially parallel to a support surface or a floor surface are not canceled by each other but are superposed on each other whereby the sound pressure is enhanced.

According to the speaker 10, the sound pressure of the sound waves radiated from the curved inner surface of the oscillator 12 is increased by the hole 28 of the horn 22 and therefore, the transformation efficiency from electric signal to sound wave is excellent.

Further, according to the speaker 10, the size or length of the path 36 communicating with the opening portion of the hole 28 of the horn 22 can be changed by changing the length of the support members 32 whereby the cut-off frequency of the horn 22 can be adjusted and the frequency characteristic thereof can be adjusted.

Figure 4:
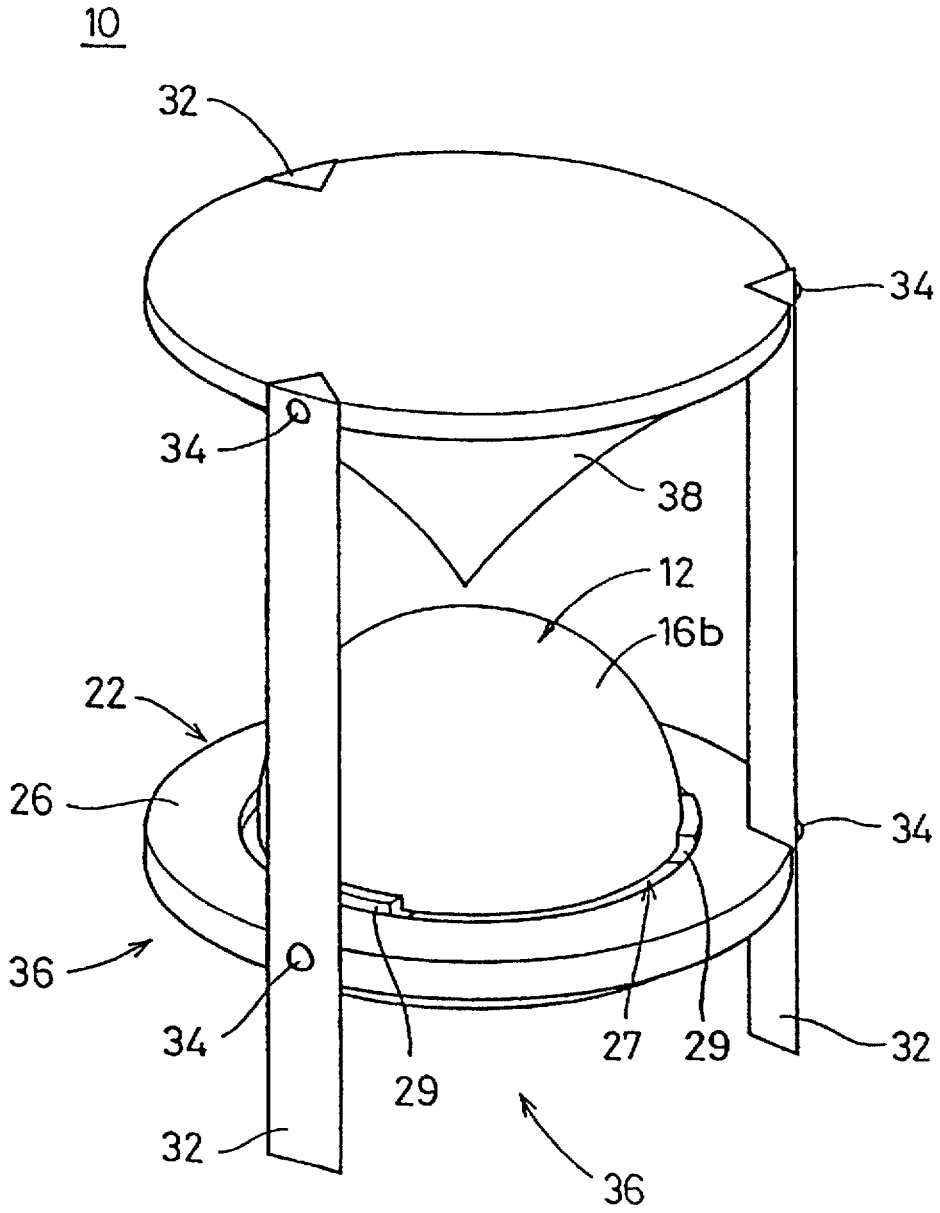
FIG. 4 is a perspective view showing another example of preferred embodiments of the present invention.

FIG. 4 is a perspective view showing another example of preferred embodiments of the present invention. According to a speaker illustrated by FIG. 4, compared with the speaker illustrated by FIG. 1 through FIG. 3, the support members 32 extend upwardly above the oscillator 12 and a reflecting member 38 is arranged above the curved outer surface of the oscillator 12. The reflecting member 38 is fixed to the upper ends of the support members 32 respectively by connecting members 34. The reflecting member 38 is arranged to reflect the sound waves radiated upwardly from the curved outer surface of the oscillator 12 in all directions relative to an installation surface or a floor surface upon which the speaker is supported.

The speaker illustrated by FIG. 4 radiates sound waves in an omni-directional manner relative to an installation surface or a floor surface similar to the speaker illustrated by FIG. 1 through FIG. 3, the sound pressure is enhanced relative to an installation surface or a floor surface, the transformation efficiency from electric signal to sound wave is improved and the cut-off frequency and the frequency characteristic can be easily and quickly adjusted.

According to the speaker illustrated by FIG. 4, compared with the speaker illustrated by FIG. 1 through FIG. 3, the sound waves upwardly radiated from the curved outer surface of the oscillator 12 are reflected in all directions relative to an installation surface or a floor surface and therefore, the sound pressure is enhanced in all directions relative to an installation surface or a floor surface.

Figure 5:
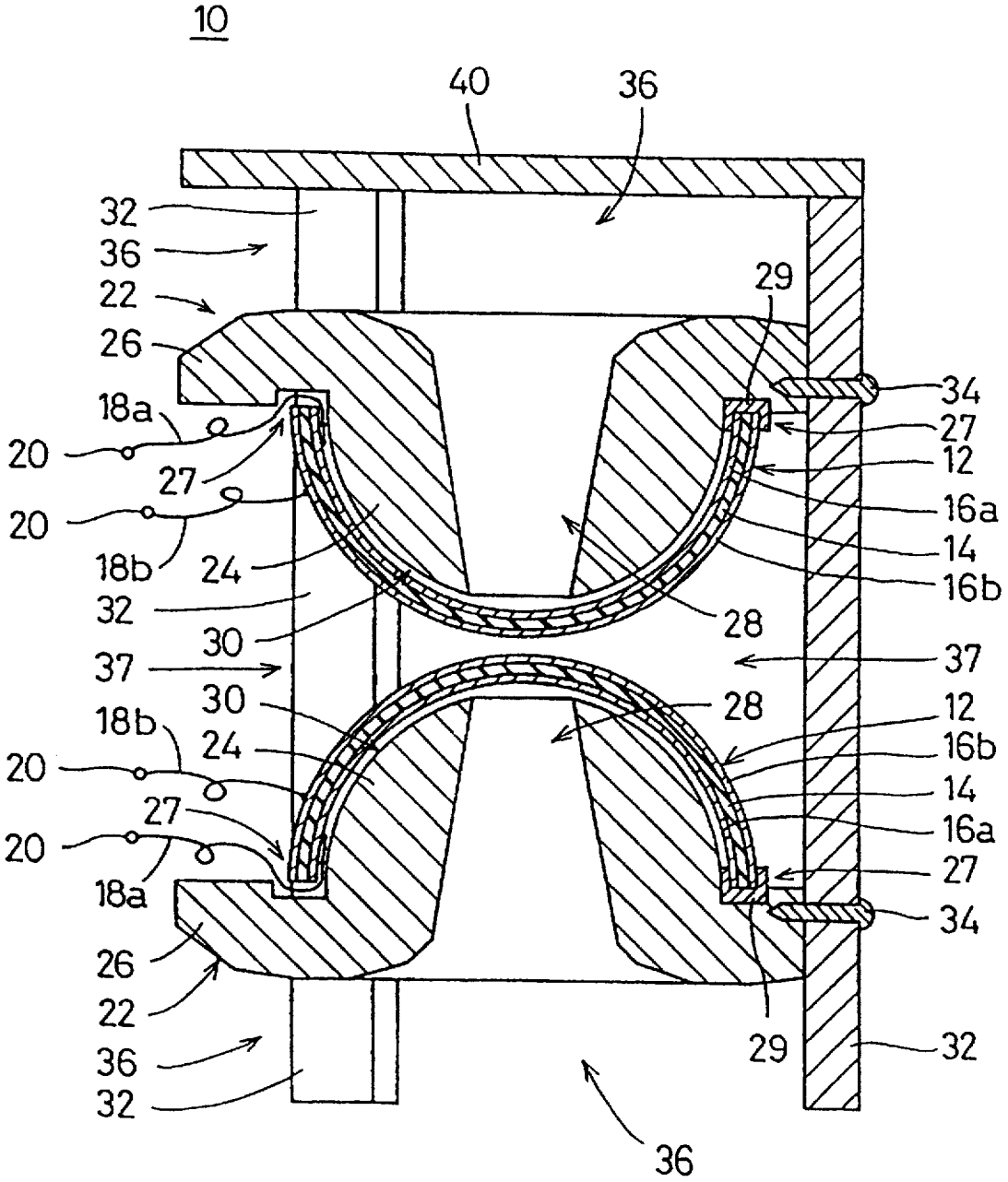
FIG. 5 is a sectional view showing still another example of preferred embodiments of the present invention.

FIG. 5 is a sectional view showing still another example of preferred embodiments of the present invention. A speaker 10 illustrated by FIG. 5 preferably includes two sets of the oscillators 12 and the horns 22. The oscillators 12 and the horns 22 are similar to the oscillators and the horns used in the respective speakers illustrated by FIG. 1 through FIG. 4 and are similarly fixed.

The two sets of the oscillators 12 and horns 22 are connected by a plurality of support members 32 preferably arranged in a triangular column shape and made of, for example, aluminum such that the curved outer surfaces of the two oscillators 12 are disposed opposite to each other and are spaced from each other by a desired distance. The members 32 are fixed to the flange portions 26 of the two horns 22 by the connecting members 34. Furthermore, a top plate 40 preferably having a disk-like shape and made of, for example, aluminum, is adhered onto the upper end portions of the members 32 to function as a baffle.

A first sound transmission path 36 for transmitting sound waves in substantially all directions relative to an installation surface or a floor surface, is formed between the horn 22 on the lower side and an installation surface or a floor surface. Similarly, a second sound transmission path 36' for transmitting sound waves in substantially all directions relative to the installation surface or the floor surface is also defined between an upper surface of the uppermost horn 22 and the top plate 40. Further, a third sound transmission path 37 for transmitting sound waves in substantially all directions relative to an installation surface or a floor surface is defined between the two horns 22.

Incidentally, to prevent the sound waves radiated from the curved outer surfaces of the two oscillators 12 via the third path 37 and the sound waves radiated from the curved inner surfaces of the two oscillators 12 via the cavities 30, the holes 28 and the paths 36, 36' from canceling each other, the cavities 30, the holes 28 and the paths 36, 36' and 37 are arranged such that these sound waves are provided with substantially the same phase in all directions relative to an installation surface or a floor surface of the speaker 10.

According to the speaker 10 illustrated by FIG. 5, an when electric signal is inputted to the input terminals 20, the two oscillators 12 are oscillated, the sound waves are radiated from the curved outer surfaces of the two oscillators 12 via the third path 37 and the sound waves are also radiated from the curved inner surfaces of the two oscillators 12 via the cavities 30, the holes 28 and the paths 36 and 36'.

The sound waves radiated from the curved outer surfaces of the two oscillators 12 via the path 37, are radiated in all directions and are omni-directional relative to the installation surface since the path 37 extends in all directions relative to the installation surface or floor surface upon which the speaker is supported. Further, the sound waves radiated from the curved inner surfaces of the two oscillators 12 via the cavities 30, the holes 28 and the paths 36, 36' are radiated in all directions and are omni-directional because the paths 36, 36' extend substantially in all directions relative to the installation surface or a floor surface. Accordingly, the speaker 10 illustrated by FIG. 5 is omni-directional relative to an installation surface or a floor surface.

The difference between phases of the sound waves radiated from the curved outer surfaces of the two oscillators 12 and the sound waves radiated from the curved inner surfaces of the oscillator 12 is about 180°. However, these sound waves are made to have substantially the same phase relative to directions parallel to an installation surface or a floor surface by the cavities 30, the holes 28, the paths 36, 36' and 37 which are used as a phase shifting device. Therefore, according to the speaker 10 illustrated by FIG. 5, these sound waves are not canceled by each other but superposed on each other in all directions relative to an installation surface or a floor surface whereby the sound pressure is enhanced.

Furthermore, according to the speaker illustrated by FIG. 5, compared with the respective speakers illustrated by FIG. 1 through FIG. 4, the sound waves are radiated from the two oscillators 12 whereby the sound pressure is further enhanced.

According to the speaker 10 illustrated by FIG. 5, the sound pressure produced by the sound waves radiated from the curved inner surfaces of the two oscillators 12 is enhanced by the holes 28 of the horns 22 and therefore, the transformation efficiency from electric signal to sound wave is improved.

Furthermore, according to the speaker 10 illustrated by FIG. 5, the sizes of the paths 36, 36' communicating with the holes 28 of the two horns 22 and the size of the path 37 are easily and quickly changed by changing the length of the support members 32 and therefore, the cut-off frequency of the two horns 22 can respectively be adjusted and the frequency characteristic of the speaker can be improved.

Figure 6:
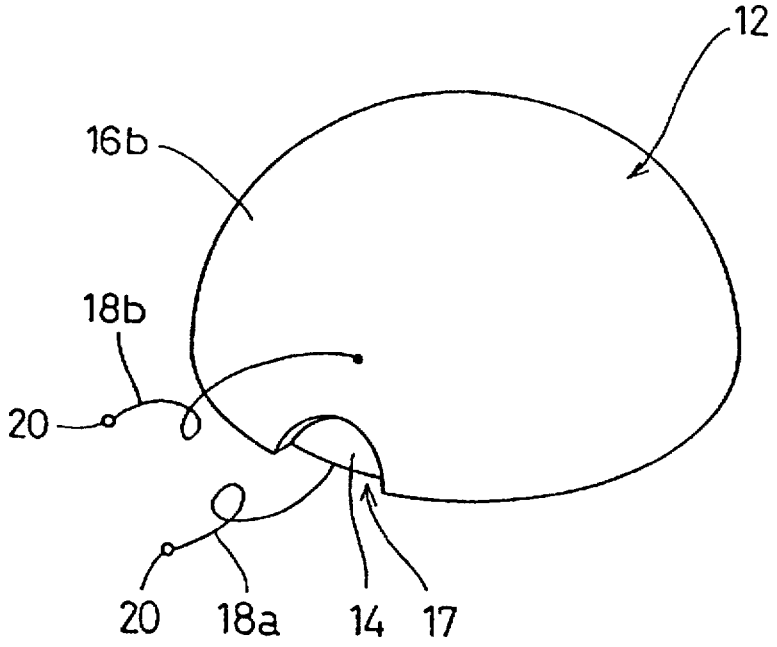
FIG. 6 is a perspective view showing a modified example of an oscillator.

Incidentally, although according to above-described preferred embodiments of the present invention, the grooves 27 and the spacers 29 are formed in order that the electrodes 16*a* and 16*b* are not shortcircuited by the lead wires 18*a*, instead of forming the grooves 27 and the spacers 29, a cut-off portion 17 removing a portion of each of the electrodes 16*b* may be formed at the end portion of the oscillating body 14 of the oscillator 12 as illustrated by FIG. 6. In this case, to prevent the electrodes 16*a* and 16*b* from being shortcircuited by the lead wire 18*a*, the lead wire 18*a* may be pinched by the oscillating body 14 and the horn 22 at portions thereof where the cut-off portion 17 is formed.

Although according to the above-described preferred embodiments of the present invention the oscillators in each of which the electrodes are formed on the curved inner surface and outer surface of the oscillating body constituted by a piezoelectric body, in place of such an oscillator, an oscillator on which a piezoelectric element functioning as a driving device for oscillating the oscillating body is adhered onto a portion of a hemispherical oscillating body made of, for example, metal, ceramics or synthetic resin may be used.

Although according to the above-described preferred embodiments of the present invention, the horn, the support members and the top plate are made of aluminum, the horn, the support members and the top plate may be made of other metal, wood, synthetic resin, ceramics, glass or the like.

Although according to the above-described preferred embodiments of the present invention the support members having a triangular column shape are used, the shape of the support members may arbitrarily be changed to other column shapes such as a circular column shape, a quadrangular column shape or the like, and also the number of the support members is not limited to three but may be one, two, four or more than four.

Additionally, an acoustic equalizer may be installed on the central axis of the hole 28 to promote the accuracy of the opening rate of the hole 28 of the horn 22.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A speaker comprising:

a hemispherical oscillating body;

a driver for driving the oscillating body;

a horn arranged to extend from a curved inner surface of the oscillating body toward an installation surface which is not part of the speaker and upon which the speaker is supported such that the horn is spaced away from the installation surface, the horn having a hole gradually expanding from the curved inner surface of the oscillating body toward the installation surface;

a cavity communicating with the hole of the horn and being defined between the oscillating body and the horn; and a sound transmission path defined by an area located between the horn and the installation surface upon which the speaker is supported, the sound transmission path arranged to communicate with the hole of the horn and to radiate sound waves in substantially all directions toward the installation surface.

2. The speaker according to claim 1, further comprising a reflecting member arranged above a curved outer surface of the oscillating body for reflecting sound waves radiated from the curved outer surface of the oscillating body in substantially all directions relative to the installation surface.

3. The speaker according to claim 1, wherein the oscillating body comprises a first oscillating body, the driver comprises a first driver, the horn comprises a first horn, the cavity comprises a first cavity and the sound transmission path comprises a first sound transmission path, the speaker further comprising:

a second hemispherical oscillating body having a hemispherical shape and arranged such that a curved outer surface of the second oscillating body is opposed to the curved outer surface of the first oscillating body, the first and second oscillating bodies being spaced from each other;

a second driver for driving the second oscillating body;

a second horn arranged to extend from a curved inner surface of the second oscillating body toward an outside of the second oscillating body, the second horn having a hole gradually expanding from the curved inner surface of the second oscillating body toward the outside of the second oscillating body;

a second cavity communicating with the hole of the second horn and being defined between the second oscillating body and the second horn;

a baffle arranged in proximity to an opening portion of the hole of the second horn and having a surface opposed to the opening portion of the hole of the second horn and arranged substantially parallel to the installation surface;

a second sound transmission path communicating with the hole of the second horn and being defined between the second horn and the baffle and being arranged to radiate sound waves in substantially all directions relative to the installation surface; and a third sound transmission path defined between the first oscillating body and the second oscillating body and being arranged to radiate sound waves in substantially all directions relative to the installation surface.

4. The speaker according to claim 1, wherein the cavity, the hole and the sound transmission path are arranged such that sound waves radiated from the curved outer surface of the oscillator and sound waves radiated from the curved inner surface of the oscillator are provided with substantially the same phase relative to the installation surface.

5. The speaker according to claim 1, further comprising a plurality of support members supporting the oscillating body and the horn at a distance from the installation surface so as to define the sound transmission path.

6. A speaker comprising:

an oscillating body;

a driver for driving the oscillating body;

a horn arranged to support the oscillating body, the horn having a hole extending from an inner portion of the oscillating body toward an installation surface which is not part of the speaker and upon which the speaker is supported;

a cavity communicating with the hole of the horn and being defined between the oscillating body and the horn; and at least one support member for supporting the oscillating body and the horn on the installation surface such that the horn is spaced from the installation surface; wherein the horn is arranged such that the hole in the horn extends in a direction substantially perpendicular to the installation surface.

7. The speaker according to claim 6, wherein the at least one support member and the horn are arranged to define a sound transmission path extending between the horn and the installation surface, the sound transmission path being arranged to communicate with the hole of the horn and to radiate sound waves in substantially all directions relative to the installation surface.

8. The speaker according to claim 7, further comprising a reflecting member arranged above a curved outer surface of the oscillating body for reflecting sound waves radiated from the curved outer surface of the oscillating body in substantially all directions relative to the installation surface.

9. The speaker according to claim 7, wherein the oscillating body comprises a first oscillating body, the driver comprises a first driver, the horn comprises a first horn, the cavity comprises a first cavity and the sound transmission path comprises a first sound transmission path, the speaker further comprising:

a second oscillating body arranged such that an outer surface of the second oscillating body is opposed to the outer surface of the first oscillating body, the first and second oscillating bodies being spaced from each other;

a second driver for driving the second oscillating body;

a second horn arranged to extend from an inner surface of the second oscillating body toward an outside of the second oscillating body, the second horn having a hole extending from the inner surface of the second oscillating body toward the outside of the second oscillating body;

a second cavity communicating with the hole of the second horn and being defined between the second oscillating body and the second horn;

a baffle arranged in proximity to an opening portion of the hole of the second horn and having a surface opposed to the opening portion of the hole of the second horn and arranged substantially parallel to the installation surface;

a second sound transmission path communicating with the hole of the second horn and being defined between the second horn and the baffle and being arranged to radiate sound waves in substantially all directions relative to the installation surface; and a third sound transmission path defined between the first oscillating body and the second oscillating body and being arranged to radiate sound waves in substantially all directions relative to the installation surface.

10. The speaker according to claim 6, wherein the oscillating body comprises a hemispherical shaped body having a curved inner surface and a curved outer surface.

11. A speaker comprising:

an oscillating body having a curved inner surface and a curved outer surface;

a driver for driving the oscillating body;

a horn disposed partially within an inner area defined by a circumferential edge of the oscillating body, the horn having a hole extending from the curved inner surface of the oscillating body toward the outside of the inner area defined by the circumferential edge of the oscillating body and an installation surface upon which the speaker is supported and which installation surface is not part of the speaker; and at least one supporting member for supporting the horn and the oscillating body spaced from the installation surface; wherein the oscillating body is arranged to be driven by the driver to radiate sound waves from the curved outer surface thereof in substantially all directions away from the installation surface and to radiate sound waves via the horn in substantially all directions toward the installation surface.

12. The speaker according to claim 11, further comprising a cavity communicating with the hole of the horn and being defined between the oscillating body and the horn.

13. The speaker according to claim 12, further comprising a sound transmission path defined between the horn and the installation surface, the sound transmission path arranged to communicate with the hole of the horn and to radiate sound wave in substantially all directions relative to the installation surface.

14. The speaker according to claim 11, wherein the horn has a shape that substantially corresponds to a shape of the curved inner surface of the oscillating body.

15. The speaker according to claim 11, wherein the horn comprises a substantially hemispherical projection portion disposed within the inner area defined by the circumferential edge of the oscillating body and a flange portion located at an outer periphery of the horn, the oscillating body being supported on the flange portion.

16. The speaker according to claim 15, wherein the horn further comprises a groove defined between the projection portion and the flange for supporting the oscillating body.

17. The speaker according to claim 11, further comprising a reflecting member arranged above the curved outer surface of the oscillating body for reflecting sound waves radiated from the curved outer surface of the oscillating body in substantially all directions relative to the installation surface.

18. The speaker according to claim 13, wherein the oscillating body comprises a first oscillating body, the driver comprises a first driver, the horn comprises a first horn, the cavity comprises a first cavity and the sound transmission path comprises a first sound transmission path, the speaker further comprising:

a second oscillating body arranged such that an outer surface of the second oscillating body is opposed to the outer surface of the first oscillating body, the first and second oscillating bodies being spaced from each other;

a second driver for driving the second oscillating body;

a second horn arranged to extend from an inner surface of the second oscillating body toward an outside of the second oscillating body, the second horn having a hole extending from the inner surface of the second oscillating body toward the outside of the second oscillating body;

a second cavity communicating with the hole of the second horn and being defined between the second oscillating body and the second horn;

a baffle arranged in proximity to an opening portion of the hole of the second horn and having a surface opposed to the opening portion of the hole of the second horn and arranged substantially parallel to the installation surface;

a second sound transmission path communicating with the hole of the second horn and being defined between the second horn and the baffle and being arranged to radiate sound waves in substantially all directions relative to the installation surface; and a third sound transmission path defined between the first oscillating body and the second oscillating body and being arranged to radiate sound waves in substantially all directions relative to the installation surface.

19. The speaker according to claim 11, wherein the hole in the horn extends in a direction substantially perpendicular to the installation surface.

20. The speaker according to claim 11, wherein the hole in the horn gradually expands from the curved inner surface of the oscillating body toward the outside of the oscillating body beyond the inner area defined by the circumferential edge of the oscillating body.

* * * * *